US005970558A

United States Patent [19]

Canavan et al.

[11] Patent Number: 5,970,558

[45] Date of Patent: Oct. 26, 1999

[54] FLOOR SWEEPER

[75] Inventors: Eugene M. Canavan; Oliver St. C. Hood, both of Dublin, Ireland

[73] Assignee: Bissell Inc., Grand Rapids, Mich.

[21] Appl. No.: 08/972,385

[22] Filed: Nov. 18, 1997

Related U.S. Application Data

[60] Provisional application No. 60/031,319, Nov. 19, 1996.

[51] Int. Cl.[6] ..... A47L 11/33

[52] U.S. Cl. ..... 15/41.1; 15/42; 15/45; 15/48.1

[58] Field of Search ..... 15/41.1, 42, 43, 15/44, 45, 46, 47, 48, 48.1, 48.2

[56] References Cited

U.S. PATENT DOCUMENTS

| | | | |
|---|---|---|---|
| 349,684 | 9/1886 | Bissell et al. | 15/41.1 |
| 412,219 | 10/1889 | Gates | 15/41.1 |
| 419,349 | 1/1890 | Pickett | 15/41.1 |
| 449,541 | 3/1891 | Kelley | 15/41.1 |
| 476,214 | 5/1892 | Raymond | 15/41.1 |
| 1,813,325 | 7/1931 | Smith | 15/41.1 X |
| 1,972,870 | 9/1934 | Chtistesen | 15/41.1 |
| 1,995,944 | 3/1935 | Robinson et al. | 15/41.1 |
| 2,166,977 | 7/1939 | Smith | 15/41.1 |
| 2,178,917 | 11/1939 | Pullen | 15/41.1 |
| 2,206,429 | 7/1940 | Redfearn | 15/41.1 |
| 2,502,403 | 3/1950 | Kircher | 15/41.1 |
| 2,631,312 | 3/1953 | Pullen | 15/41.1 |
| 2,651,796 | 9/1953 | Wagner et al. | 15/48 |
| 3,092,862 | 6/1963 | Sherbondy | 15/41.1 |
| 3,879,788 | 4/1975 | Cousin | 15/42 |
| 4,007,508 | 2/1977 | Ooyachi | 15/42 |
| 4,168,561 | 9/1979 | Rosendall et al. | 15/42 |
| 4,219,897 | 9/1980 | Leibscher et al. | 15/41.1 |
| 4,282,622 | 8/1981 | Rosendall | 15/41.1 |
| 4,325,156 | 4/1982 | Rosendall | 15/41.1 |
| 4,357,727 | 11/1982 | McDowell | 15/41.1 |
| 4,502,173 | 3/1985 | Patzold et al. | 15/41.1 |
| 4,701,969 | 10/1987 | Berfield et al. | 15/41.1 X |
| 4,845,797 | 7/1989 | Kobayashi | 15/41.1 |
| 5,224,232 | 7/1993 | Zahuranec et al. | 15/41.1 |

FOREIGN PATENT DOCUMENTS

| | | | |
|---|---|---|---|
| 283093 | 11/1967 | Australia | 15/41.1 |
| 0 056 251 | 7/1982 | European Pat. Off. . | |
| 0 265 015 | 4/1988 | European Pat. Off. . | |
| 1817906 | 8/1973 | Germany | 15/42 |
| 6600083 | 3/1966 | Netherlands | 15/42 |
| 410976 | 5/1934 | United Kingdom | 15/48 |
| 474772 | 11/1937 | United Kingdom . | |
| 504728 | 4/1939 | United Kingdom | 15/41.1 |
| 509443 | 7/1939 | United Kingdom | 15/41.1 |
| 638541 | 6/1950 | United Kingdom | 15/41.1 |
| 934388 | 8/1963 | United Kingdom . | |
| 1013085 | 12/1965 | United Kingdom | 15/41.1 |
| 1 271 894 | 4/1972 | United Kingdom . | |
| 1 293 873 | 10/1972 | United Kingdom . | |
| 1 552 619 | 9/1979 | United Kingdom . | |
| 2257620 | 1/1993 | United Kingdom | 15/41.1 |

*Primary Examiner*—Mark Spisich

*Attorney, Agent, or Firm*—Rader, Fishman, Grauer & McGarry, an Office of Rader, Fishman & Grauer PLLC

[57] ABSTRACT

A sweeper comprising a housing, at least one drawer, and at least one brush rotatably mounted to the housing for sweeping debris into the drawer. The housing forms an opening for removably mounting the drawer for movement between an open and a closed position. The sweeper is rollably supported on wheels which drive the brush. The sweeper incorporates modular features which allow the sweeper to be assembled without the use of tools.

20 Claims, 8 Drawing Sheets

FLOOR SWEEPER

CROSS-REFERENCE TO RELATED APPLICATIONS

This application claims priority pursuant to 35 U.S.C. § 119 of U.S. provisional patent application Ser. No. 60/031,319, filed Nov. 19, 1996.

BACKGROUND OF THE INVENTION

1. Field of the Invention

This invention relates to floor sweepers. In one of its aspects, the invention relates to a floor sweeper having multiple brushes for sweeping dirt from a carpet into a receptacle.

2. Description of the Related Art

Floor sweepers having one or more rotatable brush rollers for sweeping debris into an on-board dust pan have been developed to the point where they function very adequately on smooth floors as well as carpets. See, for example, U.S. Pat. No. 3,457,575 entitled "Sweeper For Carpeted And Smooth Floors".

Modern day floor sweepers are expected to pick up a variety of different types of debris including not only lint, thread, sand and the like, but also larger items such as cigarette butts. In designing floor sweepers of improved construction, problems are always found relative to the placement and mounting of the various elements. This is especially true in connection with the wheels and brush rollers, retaining springs, dust pans, bail, and the like. It is important that the lower unit of a floor sweeper be designed so that it can be manufactured economically, as well as assembled and serviced with a minimum of difficulty. The elements of the sweeper should cooperate and function in the most efficient manner possible, keeping in mind the need for a compact unit which is visually attractive. Not all designs are highly efficient.

For example, some sweepers have separate upwardly removable dust pans with peripheral shoulders which cooperate with an upper peripheral ledge on the sweeper housing so that the ledge supports the pans. Alternately, the floors of upwardly removable pans are sometimes supported by bottom walls in the housing. Bails have often been formed of special parts useful for the bail alone, thus requiring separate manufacturing operations for this relatively simple device.

As a further example, the support wheels of prior sweepers have not always been positioned or adapted to function in a manner to promote overall sweeper efficiency or for ease of installation and manufacture.

It is well recognized that floor sweepers should have the highest pickup efficiency possible so that a minimum of debris remains on the floor surface after several passes of the sweeper thereover.

SUMMARY OF THE INVENTION

In one aspect, the invention relates to a wheeled sweeper comprising a housing and at least one drawer. The at least one drawer preferably has an upstanding projection. At least one brush is rotatably mounted to the housing for sweeping debris into the at least one drawer. The housing forms an opening for removably mounting the at least one drawer for movement between an open and a closed position. The housing and the drawer have detent elements which are aligned when the drawer is closed to retain the drawer in the closed position. The housing is sufficiently resilient to releasably retain the at least one drawer in the closed position.

The drawer including the drawer detent element is preferably integrally molded in one piece from a synthetic resin material. One of the detent elements preferably is a detent tooth which is positioned on the cover adjacent to the opening formed therein. The at least one drawer can have a handle on an end portion thereof and one of the detent elements is an upstanding projection formed adjacent to the handle. The detent tooth can be formed on a central portion of the cover. The base can have a pair of side walls, and each side wall has a downwardly-sloped rail adjacent to the opening in supporting relationship to the at least one drawer.

In another aspect, the invention relates to a wheeled sweeper comprising a housing and at least one drawer integrally molded in one piece from a synthetic resin material.

In an additional aspect, the invention relates to a sweeper having a housing comprising a pair of separate cassettes and a base. The cassettes are mounted to opposite sides of the base and the cassettes mount at least one of the two axles and the at least one brush. At least one of the two axles can preferably be mounted to the cassettes and then mounted to the base as a unit.

At least two of the axles can comprise a first and second axle wherein the first and second axles are U-shaped and are each mounted to one of the cassettes and support a pair of wheels on one of the sides of the base. Each of the cassettes can further comprise an elongated retainer positioned intermediate to the ends of the first and second axles. A third axle can also be provided whereby the elongated retainer on each cassette mounts an end of the third axle therein for sliding movement with respect to the cassettes. The at least one brush preferably comprises a pair of elongated brushes which are mounted to the cassette on either side of the third axle. Each of the elongated brushes preferably has ends with a hub and an aperture in the hub whereby each of the cassettes comprises a pair of circular protrusions forming bearings for journaling the hubs thereon. The protrusions are positioned on flexible tab portions of the cassette and the tab portions are resilient to selectively release the at least two brushes from the cassettes. The cassettes preferably have detents and retainers for snap-fit connection of each cassette to the base. More specifically, each of the cassettes has first, second and third portions, the second portion being between the first and third portion, whereby a first spring interconnects the first and second portions and a second spring interconnects the second and third portions. The first and third portions have retainers thereon, the U-shaped axles have legs which are mounted in the retainers, and the springs bias the legs within the retainers.

In a further aspect, the invention relates to a sweeper comprising a housing which comprises a base and a cover, a bail pivotally mounted to the housing wherein the bail comprises a vertical handle portion and a horizontal connector portion. The cover and base preferably have opposing flanges with notches therein which cooperate to receive and pivotally mount the horizontal connector portion when the cover is mounted to the base.

In one embodiment, the bail can be T-shaped. The vertical handle portion can have a frustoconical connector which snap-fits into a socket in an end portion of a handle shaft.

In another aspect, the invention relates to a sweeper comprising a housing having a pair of opposing sides and at least two resilient retainers mounted to each opposing side thereof. The retainers have a bearing for journaling a respective rotatable support element of the brushes thereon. The retainers thereby releasably mount the at least one brush for rotation on the housing.

The housing can further comprise a cover and the retainers and the cover have a detent mechanism for snap-fit mounting the retainers to the cover. The housing can comprise a base and the retainers are mounted to the base. The rotatable support element upon the ends of the brush comprises a hub with an aperture and the bearing comprises a cylindrical protrusion.

In an additional aspect, the invention relates to a sweeper comprising a housing having a pair of opposing sides and at least two retainers mounted to each opposing side thereof. At least two axles are mounted to the housing, whereby each axle mounts a pair of wheels. The axles are U-shaped and have a pair of legs with a bight portion intermediate the legs which are received within the at least two retainers on each opposing side of the housing. A spring biases the legs against the retainers to retain the axles in the housing.

The spring can be formed in the housing or the spring can be formed in the bight portion of the axles.

BRIEF DESCRIPTION OF THE DRAWINGS

The invention will now be described with reference to the drawings in which.

DETAILED DESCRIPTION OF THE PREFERRED EMBODIMENTS

Figure 1:
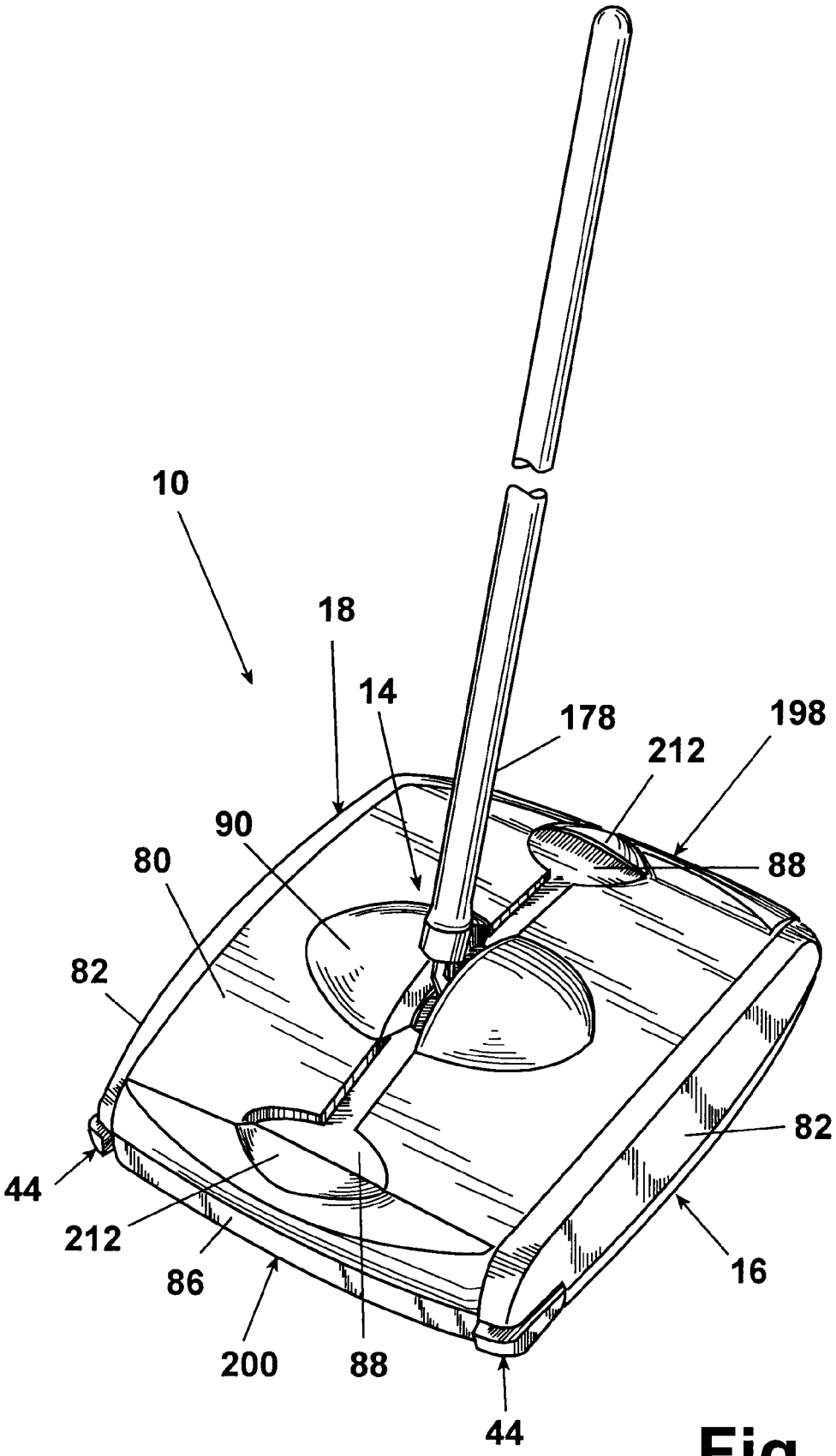
FIG. 1 is a perspective view of a first embodiment of a floor sweeper according to the invention.
Figure 2:
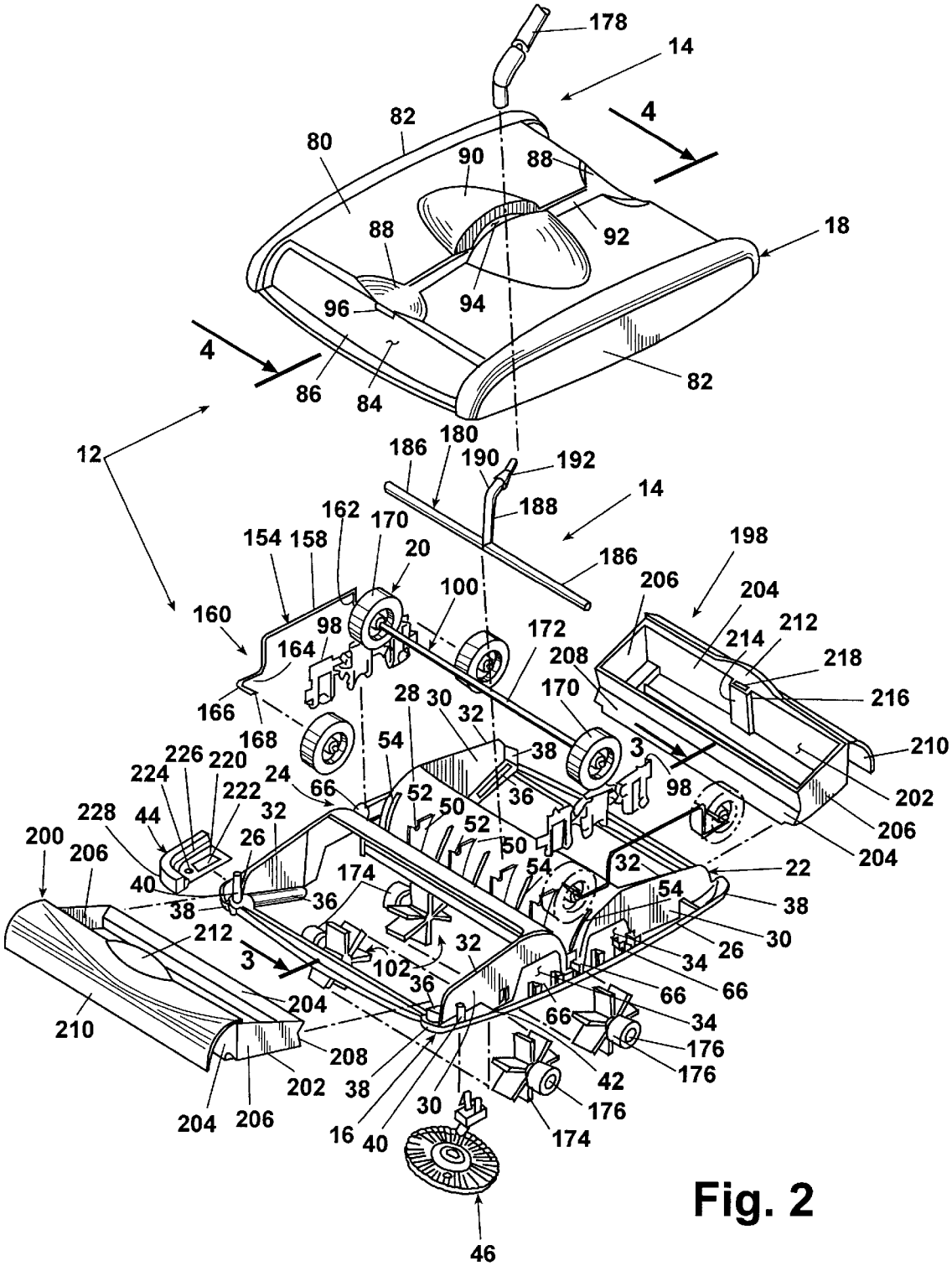
FIG. 2 is an exploded view of a lower unit of the floor sweeper of FIG. 1.

Referring now to the drawings and to FIGS. 1–2 in particular, a sweeper 10 according to the invention comprises a lower unit 12 having a pivotable handle assembly 14 mounted thereto. The lower unit 12 comprises a base 16, a cover 18 and a wheel/brush assembly 20. As seen in FIGS. 1–2 and in greater detail in FIG. 3, the base 16 comprises first and second housings 22 and 24 supported at a lower edge thereof by a rounded rectangular outer lip 26. It will be understood that the housings 22 and 24 are similar components which are described by common reference numerals for shared components or features.

Each housing 22 and 24 comprises a transversely-extending semi-cylindrical wall 28 which extends upwardly from the lip 26 and terminates in a pair of sidewalls 30 having a tapering upper edge 32. Each sidewall 30 further includes a rectangular aperture 34 adjacent the semi-cylindrical wall 28 and a pair of inwardly-extending rails 36. The rails 36 define a ramped surface adapted to support a bottom surface of a debris-receiving drawer.

It will be further understood that the first and second housings 22 and 24 are disposed on the outer lip 26 of the base 16 so that the semi-cylindrical walls 28 of each housing 22 and 24 are located at an inward central portion of the base 16 and the sidewalls 30 of each housing 22 and 24 extend forwardly and rearwardly therefrom and define longitudinal walls along each side of the base 16.

The outer lip 26 is preferably configured as a rounded rectangular shape having four corners 38 thereon. An upwardly-extending shaft 40 can be located adjacent each corner 38 which, in turn, is located outwardly of a downwardly-opening rectangular aperture 42. The shaft 40 is adapted to receive an elastomeric bumper 44 and the rectangular aperture 42 is adapted to receive an edge brush assembly 46 to enhance the edge-cleaning capabilities of the sweeper 10.

A central channel 48 of the base 16 is defined between the semi-cylindrical walls 28 of the first and second housings 22 and 24. Several spaced integrally-molded flanges 50 extend longitudinally outwardly into the channel 48 from one of the housings 22 and 24. Each flange 50 is provided with a semi-circular recess 52 at an upper edge thereon. The housings 22 and 24 can also be provided with one or more ribs 54 to reinforce the semi-cylindrical walls 28 of the housings 22 and 24. The ribs 54 can be interspersed between the flanges 50 as needed.

The flanges 50 extend into the channel a sufficient extent to define a narrow gap 56 between the flange 50 and the oppositely-disposed housing 24. It will be understood that the flanges 50 can be disposed on the housing 24 without departing from the scope of this invention. The flanges 50 are further provided with a rectangular notch 58 located at a lower portion of the flanges 50 which define a transverse channel 60 which extends between the longitudinal edges of the base 16 and through the notches 58 in the flanges 50. Further, the ribs 54 can be provided with a tab 62 which extends between the housings 22 and 24 and upwardly from a floor 64 of the channel 48. The tabs 62 have an upper edge which generally corresponds in vertical height to a lower edge of the notch 58.

Several vertically-disposed sockets 66 are disposed along each longitudinal edge of the base 16 adapted to receive corresponding snap-fit connectors on the wheel/brush assembly 20. Preferably, each longitudinal edge of the base 16 includes three sockets 66. Each socket 66 comprises first and second L-shaped legs 68 and 70, respectively, mounted along a longitudinal edge of the base 16 in a spaced relationship. It will be understood that the first and second legs 68 and 70 are identical but for being disposed in a mirrored relationship.

Each leg 68 and 70 comprises a vertical member 72 having a C-shaped cross section which includes a transverse aperture 74 which defines a shoulder 76 at an upper edge therein. The opposite location of the legs 68 and 70 defines a vertical recess 78 therebetween having a rectangular cross section.

Figure 4:
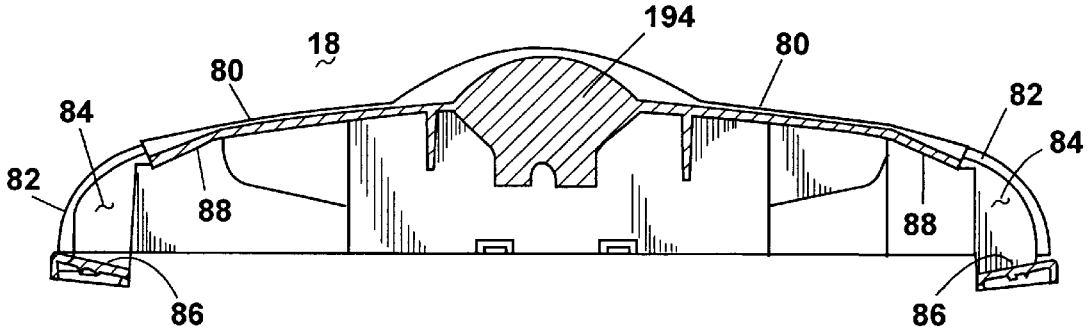
FIG. 4 is a cross-sectional view of a cover of the lower unit taken along lines 4—4 of FIG. 2.
Figure 10:
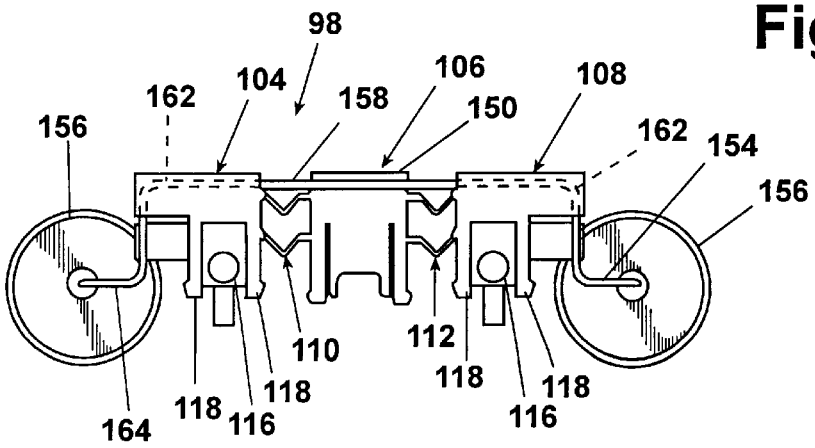
FIG. 10 is a side elevational view of a wheel cassette assembly including the wheel cassette of FIGS. 5–7, the U-shaped axle of FIGS. 8–9 and wheels on the axle.

As shown in FIGS. 1–2 and in greater detail in FIG. 4, the cover 18 comprises a suitably-shaped rounded rectangular housing adapted to mount to the base 16 which is defined by a top wall 80 and a pair of longitudinal sidewalls 82. The top wall 80 terminates a short distance before each longitudinal end of the sidewalls 82 to define a drawer-receiving recess 84 at each end thereof. A transverse support member 86 can be provided which extends between each lower edge of the sidewalls 82 to define a lower edge of each recess 84. A rounded indentation 88 is located adjacent an upper edge of each recess 84 which defines a region in which a user can insert a hand to more easily remove a debris-receiving drawer from a recess 84. An elliptical protrusion 90 extends upwardly from a central region of the top surface 80. A longitudinal groove 92 extends between the rounded indentations 88 at each longitudinal end of the top surface 80 and divides the elliptical protrusion 90. An aperture 94 is defined in the longitudinal groove 92 in the area where the groove 92 intersects with the elliptical protrusion 90. A detent 96 is defined on the underside of a central portion of each rounded indentation 88 which is adapted to engage a portion of a debris-receiving drawer to retain the drawer in a closed position.

Figure 6:
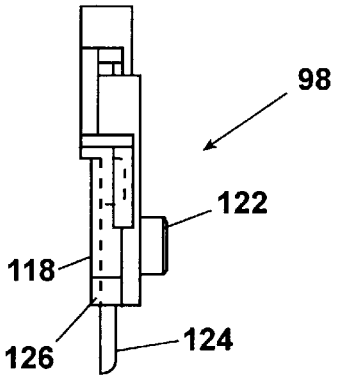
FIG. 6 is a rear elevational view of the wheel cassette of FIG. 5.
Figure 7:
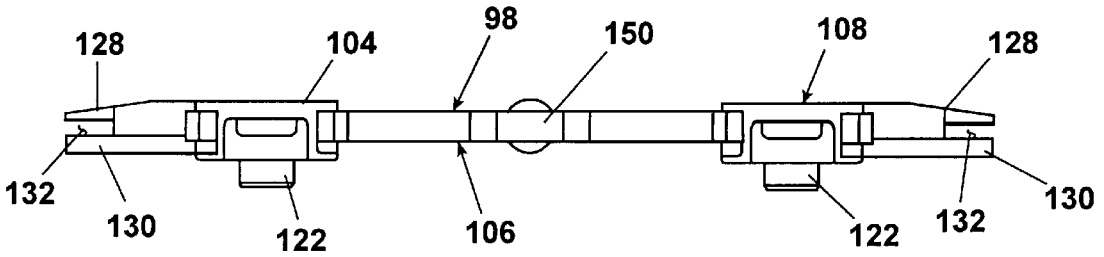
FIG. 7 is a top plan view of the wheel cassette of FIG. 5.

As shown in FIGS. 1–2, the wheel/brush assembly 20 comprises a pair of wheel cassettes 98 which are adapted to be mounted to each longitudinal edge of the base 16 which rotatably support a conventional wheel/axle assembly 100 and a pair of transversely-extending brushes 102. The wheel cassette 98 is shown in greater detail in FIGS. 5, 6 and 7.

Each wheel cassette 98 comprises first, second and third members 104, 106 and 108, respectively, whereby the first and second members 104 and 106 are interconnected by a first arm spring 110 and the second and third members are interconnected by a second arm spring 112. It will be understood that the first and third members 104 and 108 are identical except for being disposed at either end of the wheel cassette 98 and each being a mirror image of the other. It will be further understood that common reference numerals will be used to describe common features of the first and third members 104 and 108.

The first and third members 104 and 108 each comprise a generally rectangular body 114 having a downwardly-extending flange 116 and a pair of legs 118 disposed on either side of the flange 116 so that a narrow gap 120 is defined on each longitudinal edge of the flange 116 between each of the legs 118. The flange 116 includes a circular protrusion 122 on a rearward face which is adapted to receive an end of a laterally-extending brush 102. Further, a tab 124 extends downwardly from a lower edge of the flange 116. A lower end of each of the legs 118 includes a laterally-extending detent 126 thereon.

The body 114 also includes first and second flanges 128 and 130 which extend longitudinally outwardly from a forward and rearward edge, respectively, of an edge of the body 114 opposite the springs 110, 112 to define a vertical channel therebetween. In addition, a longitudinal channel 132 is defined between the flanges 128 and 130. An upper edge of the body 114 includes a rearwardly-extending protrusion 134 which defines a gap 136 therebeneath.

The second member 106 comprises a generally rectangular body 138 having a downwardly-extending flange 140 and a pair of legs 142 disposed on either side of the flange 140 so that a narrow gap 144 is defined on each longitudinal edge of the flange 140 between each of the legs 142. The flange 140 includes a semi-elliptical recess 146 which extends upwardly from a lower edge thereof. A lower end of each of the legs 142 includes a laterally-extending detent 148 thereon. An upper edge of the body 138 includes a forwardly-extending L-shaped flange 150 which defines a gap 152 therebeneath.

Figure 5:
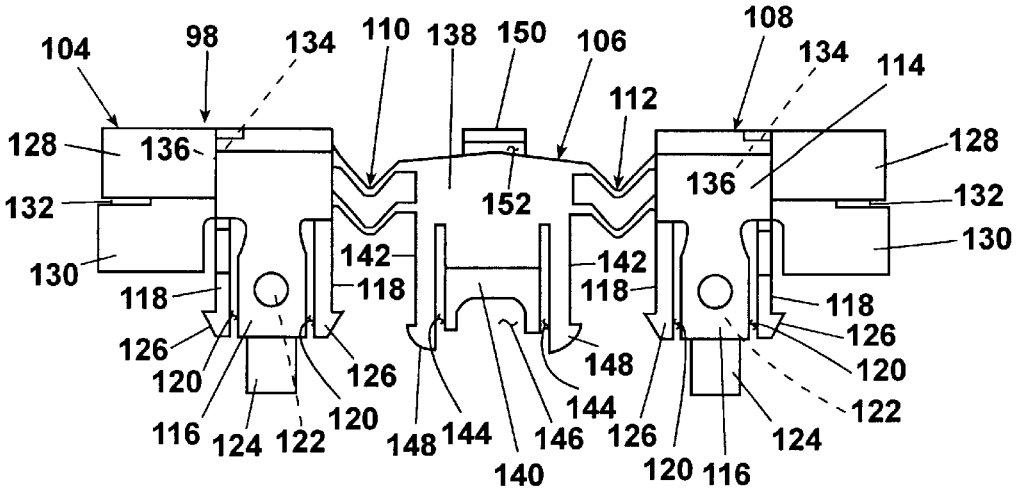
FIG. 5 is a side elevational view of a first embodiment of a wheel cassette of the floor sweeper according to the invention.

A first embodiment of the arm springs 110 and 112 on the wheel cassette 98 is shown in FIG. 5 comprising a generally V-shaped member which extends between the second member 106 and one of the first and third members 104 and 108. Additional arm springs can be added to provide additional structural stability and to increase the effective tension thereof. The arm springs 110, 112 are formed in the bent V-shape as shown to allow the first and third members 104 and 108 to flex with respect to the second member 106.

Figure 5A:
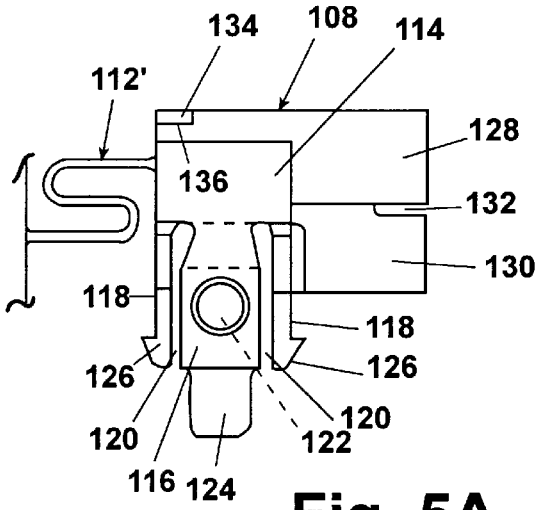
FIG. 5A is a fragmentary side elevational view of a second embodiment of the wheel cassette.

A second embodiment of the arm springs for the wheel cassette 98 is shown in FIG. 5A and referenced as spring 112'. In this embodiment, the arm spring 112' comprises an S-shaped member which is also designed to allow a degree of flex between the members 104–108.

Figure 8:
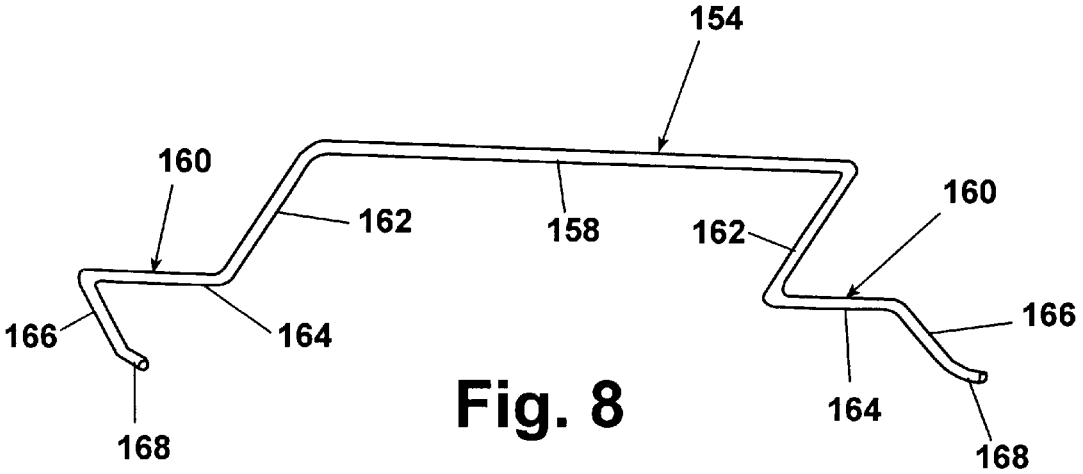
FIG. 8 is a perspective view of a U-shaped axle shown in FIG. 2.
Figure 9:
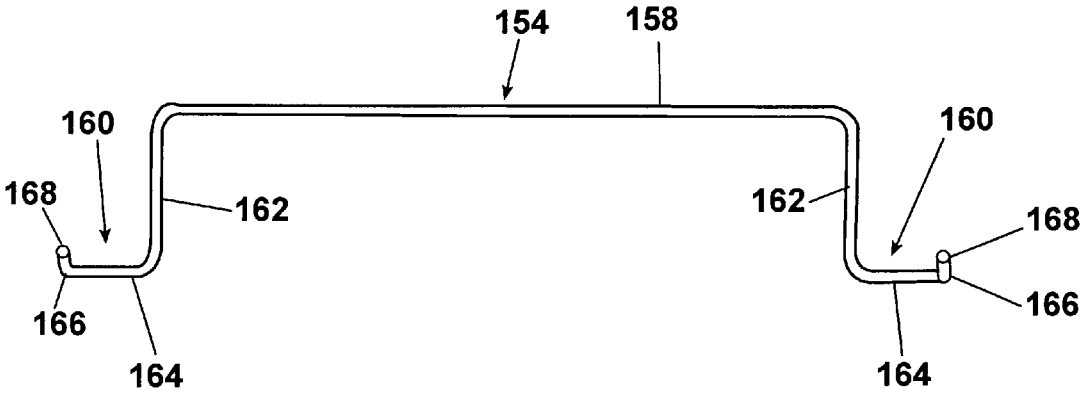
FIG. 9 is a side elevational view of the U-shaped axle of FIG. 8.

The wheel cassette 98 is adapted to support a U-shaped axle 154 which, in turn, rotatably supports a pair of wheels 156 in a longitudinally-spaced relationship. The U-shaped axle is shown in greater detail in FIGS. 8–9. The U-shaped axle 154 comprises a resilient wire 158 having each end deformed into an L-shaped extension 160 defined by a perpendicular length 162 and a parallel length 164 at a lower end thereof. Each outer end of the parallel length 164 is provided with a lateral extension 166 having an angular tip 168 which are adapted to retain wheels 156 thereon so that the wheels 156 can rotate about the lateral extensions 166 but not to become inadvertently removed therefrom.

The conventional wheel/axle assembly 100 comprises a pair of wheels 170 rotatably supported on an axle 172 as shown in FIG. 2. Each outer end of the axle 172 preferably extends beyond an outer face of the wheels 170.

The brushes 102 are any type of known brush material wound around an axle having a pair of hubs 174 disposed at each end which are provided with a circular axial aperture 176 therein.

Figure 13:
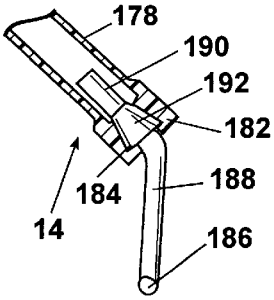
FIG. 13 is a cross-sectional view showing the mounting of a shaft to an angular extension in the handle assembly.

As shown in FIGS. 2 and 13, the handle assembly 14 comprises a shaft 178 and a T-shaped bar 180. The shaft 178 includes a hollow end portion including a bellows 182 and one or more inwardly-extending resilient protrusions 184 therein. The T-shaped bar 180 is made up of a horizontal portion 186 and a centrally-located vertical portion 188 having an upwardly-extending angular tip 190. The angular tip 190 is provided with a frustoconical neck 192 so that it is adapted to be received by the bellows 182. As shown in greater detail in FIG. 13, the neck 192 cams over the protrusions 184 in the shaft 178 and securely mounts therein.

Referring to FIGS. 5–10, the U-shaped axle 154 is mounted to a wheel cassette 98 by urging the resilient wire 158 into the gaps 134 on the first and third members 104 and 108 and into the gap 152 on the second member 106. Because the gaps 134 on the first and third members 104 and 108 are located on a rearward surface and the gap 152 is located on a forward surface, the wire 158 is securely retained thereto and is prevented from moving laterally. The perpendicular lengths 162 of the wire 158 are thereby urged between the first and second flanges 128 and 130 so that the perpendicular lengths 162 can deflect a short longitudinal distance within channel 132. The parallel lengths 164 of the wire 158 are of a sufficient length to locate the lateral extensions 166 longitudinally beyond each end of the wheel cassette 98. The lateral extensions 166 extend normal to the wheel cassette 98 on the same side as the circular protrusions 122. Wheels 156 can be rotatably mounted to the lateral extensions 166.

Figure 3:
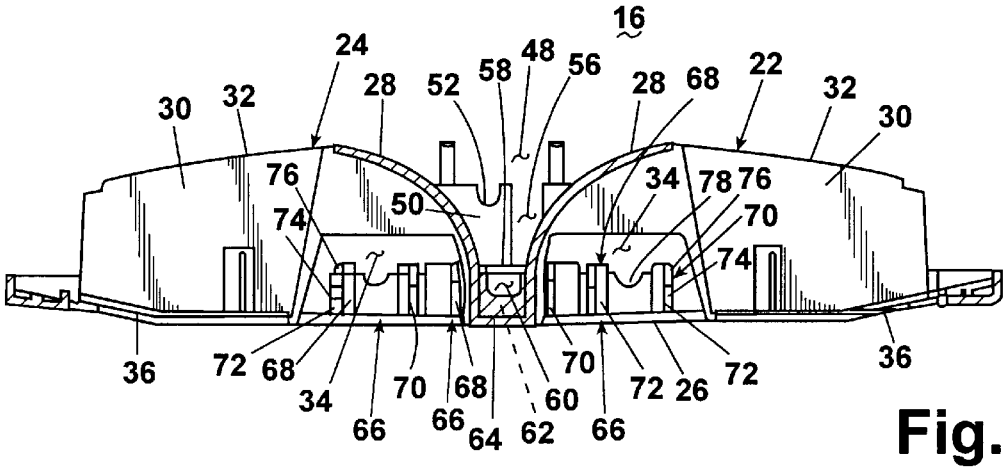
FIG. 3 is a cross-sectional view of a base of the lower unit taken along lines 3—3 of FIG. 2.
Figure 11:
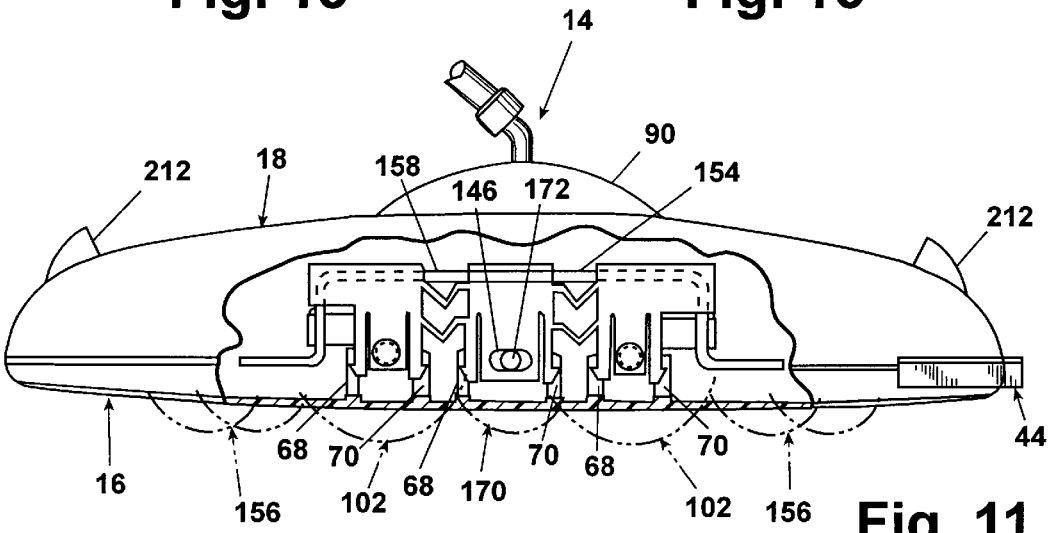
FIG. 11 is a side elevational view of the lower unit of FIG. 2 with a portion broken away to show the mounting of the wheel cassette of FIGS. 5–7 to the base of FIG. 3.

Referring to FIGS. 3 and 11, the wheel cassettes 98 are mounted to the base 16 by urging each pair of legs 118 and 142 on the first, second and third members 104, 106 and 108 into a corresponding set of three sockets 66 on each side of the base 16. As the legs 118 and 142 are urged within the sockets 66, the detents 126 and 148 thereon urge the first and second legs 68 and 70 outwardly. As the detents 126 and 148 extend downwardly a sufficient extent to clear the shoulder 76 in the aperture 74 therein, the detents 126 and 148 spring outwardly due to the resilient nature of the legs 118 and 142. The legs 118 and 142 are thereby locked within the sockets 66 by the engagement of the detents 126 and 148 against the shoulder 76.

Figure 12:
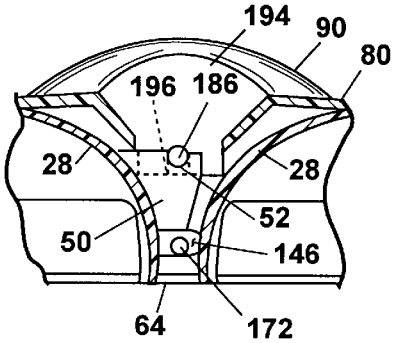
FIG. 12 is a fragmentary longitudinal section view showing a pivotable mounting of a handle assembly and a slidable mounting of a wheel axle.

Once wheel cassettes 98 are mounted to either side of the base 16, the semi-elliptical recess 146 in each wheel cassette 98 defines a longitudinal slot with a portion of the base 16. The axle 172 is mounted to the base 16 by passing the axle 172 through the gaps 56 adjacent the flanges 50 so that the axle 172 rests in the transverse channel 60 in each flange 50 and atop the tabs 62 on any ribs 54 as shown in FIGS. 2, 11 and 12. The wheels 170 are thereby mounted in the same longitudinal plane as the wheels 156 mounted on the wheel cassette 98 on each side of the base 16. The outer ends of the axle 172 rest within the slot defined by the recess 146 in each wheel cassette 98. The recess 146 is preferably of greater longitudinal length than the diameter of the axle 172 so that the axle 172 can slide longitudinally within the recess 146 in each wheel cassette 98 with the notches 58 and tabs 62 providing additional support.

The handle assembly 14 is mounted to the lower unit 12 by locating the horizontal portion 186 of the bar 180 within the semi-circular recesses 52 of the flanges 50. The cover 18 is then positioned above the base 16 so that the vertical portion 188 extends through the aperture 94 therein. The cover 18 can include several downwardly-depending flanges 194 defining a recess 196 which extends upwardly from a lower edge of the flange 194 so that the horizontal portion 186 of the handle assembly 14 is journaled within the flanges 194 on the cover 18 and the flanges 50 on the base 16 for rotational movement. The shaft 178 is mounted to the angular tip 190 by the flexible bellows 182 as described above and as shown in FIG. 13. The cover 18 can be fixedly mounted to the base 16 by several threaded fasteners or the interlocking engagement of teeth or flanges on the cover 18 and the base 16 as shown in FIG. 14.

Figure 14:
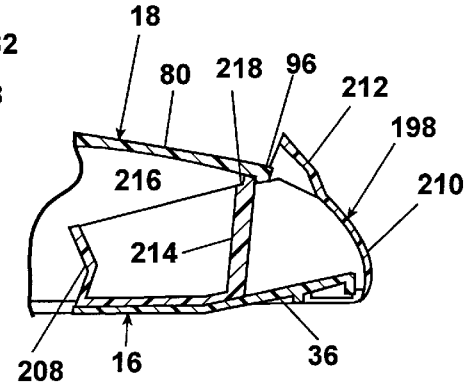
FIG. 14 is a fragmentary cross-sectional view of an interlocking detent construction of a debris-receiving drawer and the cover.

Referring to FIGS. 2 and 14, a pair of dust drawers 198 and 200 are provided, each of which forms a debris-receiving area 202 defined by a pair of transverse walls 204 and a pair of sidewalls 206. The drawers 198 and 200 are formed as a single piece by a conventional molding operation. An interior transverse wall 204 includes an inwardly-contoured surface 208 adapted to be positioned adjacent a rounded surface, such as wheels 156 on the wheel cassettes 98, positioned immediately adjacent the rounded surface and not abutting thereagainst. The opposite transverse wall 204 includes an aesthetic face plate 210 adapted to create a surface flush with the sidewalls 82 and the top surface 80 of the cover 18 when the drawers 198, 200 are mounted within the lower unit 12. The face plate 210 includes a rounded protrusion 212 which cooperates with the rounded indentation 88 on the cover 18 to form a handle assembly for a user. The drawer 198, 200 also includes a flange 214 which extends inwardly adjacent the rounded protrusion 212 and is provided with an upper surface 216 having a detent 218 protruding therefrom.

The drawers 198, 200 are spaced longitudinally and disposed at the respective front and rear ends of the lower unit 12 to form front and rear walls of the lower unit 12. The walls 204 and 206 of the drawers 198, 200 cooperate with the walls 28 of the base 16 to form openings into which debris is swept by an adjacent brush 102 therein.

The drawers 198, 200 are slidably mounted within the housings 22 and 24 on the base 16 by insertion through the drawer-receiving recesses 84 in the cover 18. The drawers 198, 200 are slidably inserted along rails 36 on the base 16. Referring to FIG. 14, the drawers 198, 200 are freely slid within the lower unit 12 until the detent 218 on the outer transverse wall 204 abuts the detent 96 on the cover 18. Upon continued lowering of the drawers 198 and 200, the detent 218 on the drawer 198, 200 causes the cover 18 to deflect slightly so that the detent 218 can be urged past the detent 96. The detent 96 is thereby lodged between the detent 218 and the transverse wall 204 of the drawer 198, 200. The drawer 198, 200 can thereby be removed for emptying by pulling axially outwardly on the drawer 198, 200 to disengage the detents 218 and 96.

The conventional wheel/axle assembly 100 is journaled within the recess slot 146 in each wheel cassette 98 so that the wheel/axle assembly 100 can slide longitudinally upon the forward and backward movement of the sweeper 10 over a ground surface. The wheels 156, 170 and brushes 102 are mounted so that one brush 102 is rotated during forward movement of the sweeper 10 and the other brush 102 is rotated during rearward movement of the sweeper 10 so that the sliding motion of the wheel/axle assembly 100 within the recess 146 permits the wheel/axle assembly 100 to contact either a forwardly- or rearwardly-located wheel 156. Any dirt or debris lifted by the brushes 102 are thrown into the corresponding drawer 198, 200.

Referring to FIGS. 2 and 11, the sweeper 10 of the present invention is provided with two brushes 102, a front brush 102 disposed directly behind a forward drawer 198 and a rear brush 102 disposed directly ahead of a rearward drawer 200. In addition, the semi-cylindrical wall 28 on each of the housings 22 and 24 of the base 16 act as a deflector disposed between the brushes 102 and are adapted to direct debris flung by the brushes 102 into their respective drawers 198, 200.

The hub portions 174 of each brush 102 has a cylindrical outer surface which engages either a forward or rearward wheel 156 and the center wheel 170 on either side of the sweeper 10 during forward and rearward motion thereof in a known manner. While one brush 102 is driven by the wheels 156, 170, the other brush 102 is undriven.

Upon forward movement of the sweeper 10 over a ground surface, the axle 172 slides rearwardly in the recess 146 in each wheel cassette 98 so that the wheels 170 engage the hubs 174 of the rearward brush. The rearward brush 102 is driven in a counterclockwise direction to fling any debris collected by the brush 102 into the rearward drawer 200. During forward motion of the sweeper, the hubs 174 of the forward brush 102 are not engaged by the wheels 156, 170.

When the sweeper moves rearwardly, the axle 172 slides forwardly in the recess 146 in each wheel cassette 98 so that the wheels 170 engage the hubs 174 of the forward brush. The forward brush 102 is driven in a clockwise direction to fling any debris collected by the brush 102 into the forward drawer 198. During rearward motion of the sweeper, the hubs 174 of the rearward brush 102 are not engaged by the wheels 156, 170.

Because the face plate 210 of each drawer 198, 200 forms the leading or trailing portion of the sweeper 10 during use, bumpers 44 can be disposed on the exposed side of each corner 38 of the sweeper 10. For this purpose, and as best shown in FIGS. 1, 2 and 11, the bumper 44 comprises a plate 220 having a rectangular aperture 222 spaced rearwardly from a circular aperture 224. The plate 220 is formed with a curved ridge 226 on its upper and lower surfaces which mimics the outer curved edges of the base 16 and cover 18. The bumper 44 is also provided with an elastomeric outer edge 228 formed of a flexible stretchable resilient material. The bumper 44 can thereby be mounted to the base 16 (prior to mounting the cover 18) by receiving the shaft 40 within the circular aperture 224 in the bumper 44 so that the edges of the cover 18 and base 16 engage the ridges 226 on the upper and lower surfaces of the plate 220, respectively.

Figure 15:
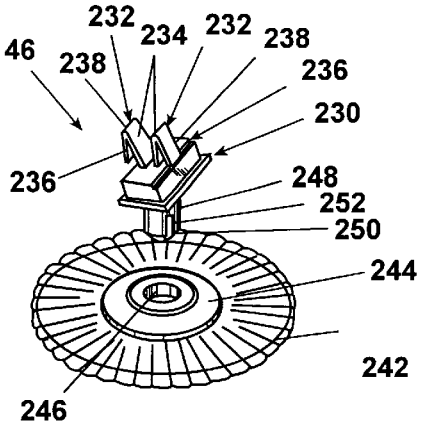
FIG. 15 is a first embodiment of an edge brush assembly.
Figure 16:
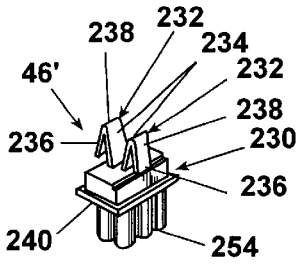
FIG. 16 is a second embodiment of an edge brush assembly.

An external brush assembly 46 can be mounted to the underside of the base 16 within one or more of the recesses defined by the rectangular apertures 42 of the base 16 and any corresponding apertures 222 from any attached bumpers 44. The brush assembly 46 increases the edge cleaning characteristics of the sweeper 10. First and second embodiments of the brush assembly 46 are shown in FIGS. 15 and 16, respectively.

It will be understood that each embodiment of the brush assembly includes a common body 230 which is adapted to be securely mounted within the rectangular apertures 42 of the base 16. The body 230 includes a pair of inverted V-shaped spring clips 232 defined by first and second legs 234 and 236 interconnected at a common vertex 238. The opposite end of the first leg 234 is fixed to an upper surface of the body 230. The opposite end of the second leg 236 is hung freely from the vertex 238 so that the spring clips 232 can flex about the vertex 238. The body 230 also includes a perimeter flange 240 which extends laterally outwardly from a lower edge of the body 230.

The body 230 is mounted to the base 16 of the sweeper 10 by urging the spring clips 232 upwardly into the rectangular aperture 42 of the base 16. Because the width of the aperture 42 is preferably less than the uncompressed width of the spring clips 232, the spring clips 232 flex inwardly about each vertex 238. Once the lower ends of the second legs 236 of each spring clip 232 clear an upper edge of the rectangular aperture 42, the spring clips 232 resiliently spring outwardly to their uncompressed width. The body 230 is thereby retained within the aperture 42 of the base 16. The perimeter flange 240 engages a lower edge of the rectangular aperture 42 and prevents the brush assembly 46 from being inadvertently pushed within the rectangular aperture 42.

It will be noted that the lower tabs 124 on each wheel cassette 98 can be deflected laterally outwardly so that the brushes 102 can be removed from the protrusions 122 thereon.

The first embodiment of the edge brush assembly 46, shown in FIG. 15, comprises a plurality of bristles 242 extending radially outwardly from a center hub 244 which has a central aperture 246. The central aperture 246 in the hub 244 is adapted to receive a resilient cylindrical shaft 248 having a lower annular lip 250. The shaft 248 can include several upwardly-extending slots 252 which allow the shaft 248 to be urged through the aperture 246 in the brush assembly. Once the annular lip 250 clears a lower edge of the aperture 246, the shaft 248 springs out to its uncompressed diameter to rotatably mount the hub 244 and bristles 242 to the shaft 248 of the body 230. This type of edge brush assembly is useful in cleaning, dusting or loosening debris along a lower edge of a vertical wall. In addition, if the bristles 242 are of a sufficient outer radius, the rotation of an adjacent wheel 156 can impart rotation to the hub 244 by engagement with the bristles 242.

The second embodiment of the edge brush assembly 46, shown in FIG. 16, comprises a plurality of bristles mounted to the underside of the body 230 which depend downwardly therefrom. This type of arrangement helps to loosen debris from a ground surface located below a longitudinal edge of the base 16.

While the illustrated embodiment is presently preferred, other embodiments may be constructed without departing from the spirit of the invention. For example, the brushes 102 can be provided with bristles made from the same or different materials, such as nylon or hog hair, and can have the same or different thickness. The brushes 102 can also be made of entirely different tufted or non-tufted types of bristles and be provided with different rotary characteristics in order to configure each brush to pick up different sizes of debris.

Figure 17:
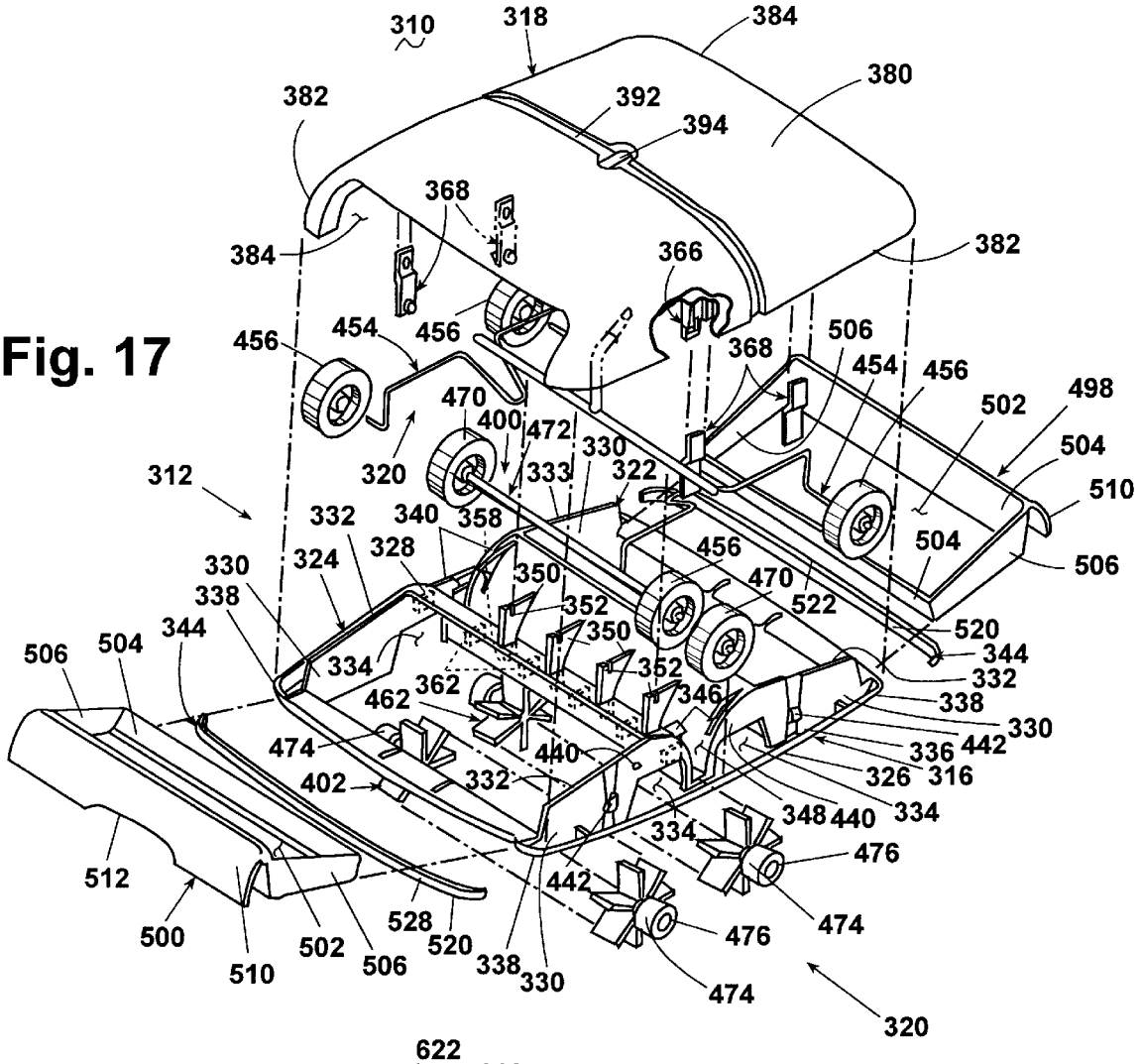
FIG. 17 is a fragmentary exploded view of a second embodiment of a floor sweeper according to the invention with some elements of the sweeper removed for clarity.
Figure 18:
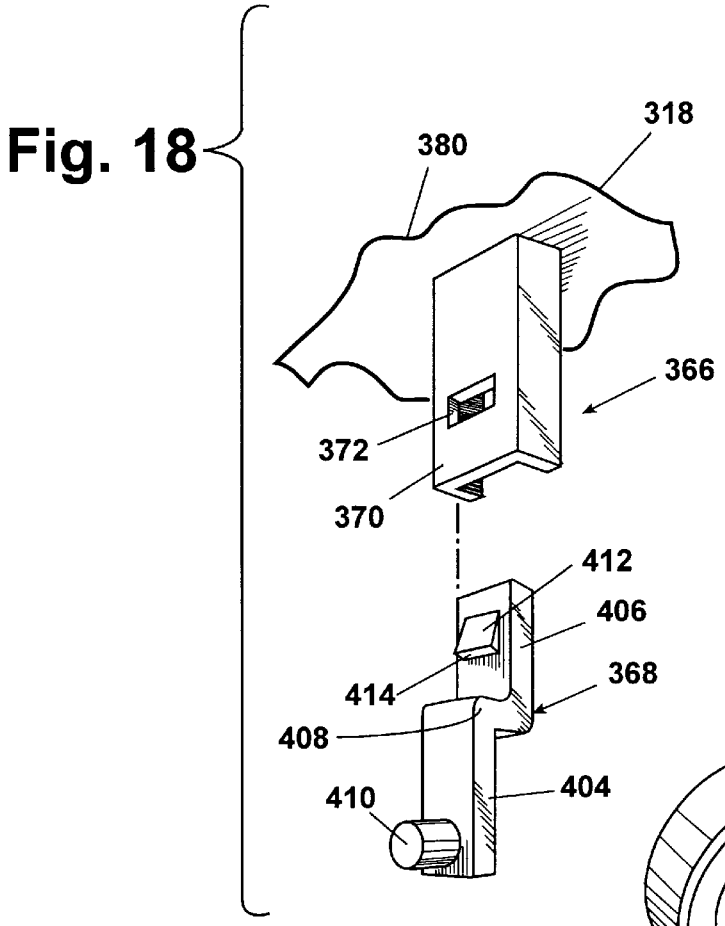
FIG. 18 is an enlarged fragmentary perspective view illustrating the assembly of a releasable mounting of a hub flange for a brush to the cover.
Figure 19:
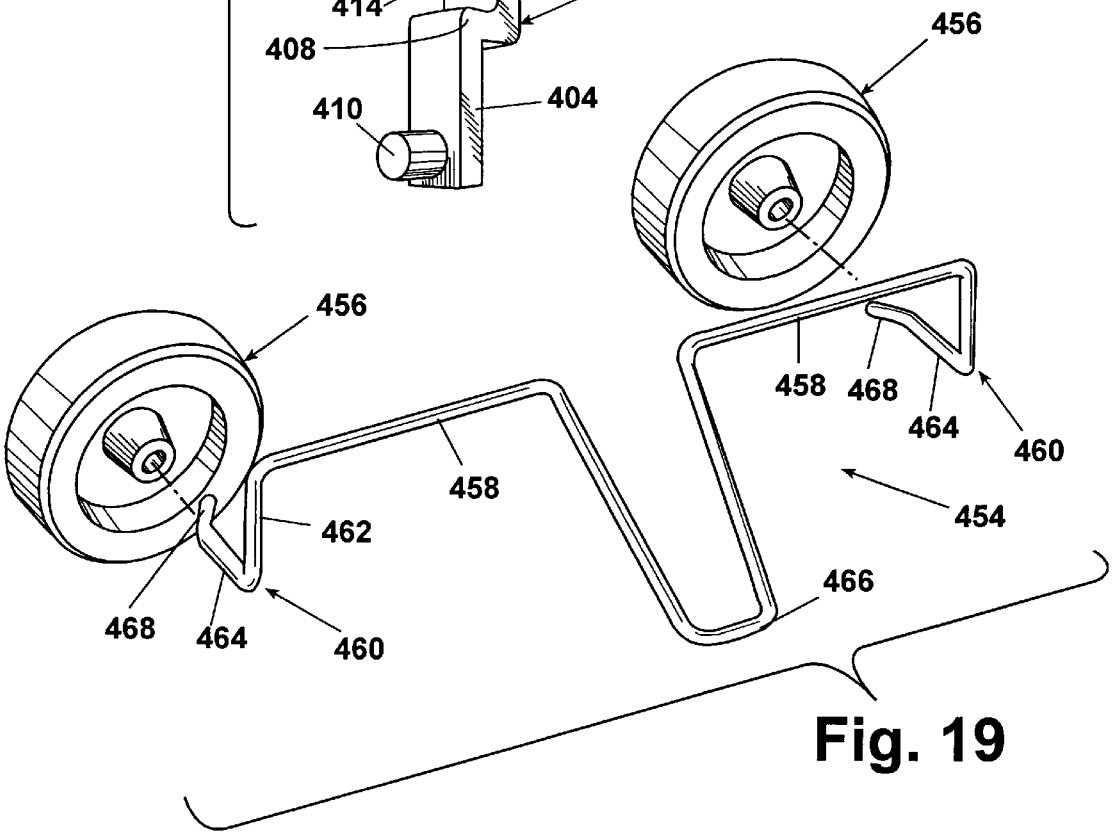
FIG. 19 is an enlarged perspective view of a U-shaped axle supporting a pair of wheels for the floor sweeper of FIG. 17.

FIGS. 17 and 19 show a second embodiment of a floor sweeper. It will be understood that reference numerals to common components in FIGS. 17–19. are greater by 300 than the reference numerals to the corresponding components in the first embodiment shown in FIGS. 1–16.

A sweeper 310 according to the invention comprises a lower unit 312 having a pivotable handle assembly (not shown) mounted thereto. It will be understood that the handle assembly of the second embodiment is configured and operated in the same manner as the handle assembly 14 of the first embodiment disclosed in FIGS. 2 and 13.

The lower unit 312 comprises a base 316, a cover 318 and a wheel/brush assembly 320. The base 316 comprises first and second housings 322 and 324 supported at a lower edge thereof by a rounded rectangular outer lip 326. It will be understood that the housings 322 and 324 are similar components which are described by common reference numerals for shared components or features.

The cover 318 comprises a suitably-shaped rounded rectangular housing adapted to mount to the base 316 which is defined by a top wall 380 and a pair of longitudinal sidewalls 382. The top wall 380 terminates a short distance before each longitudinal end of the sidewalls 382 to define a drawer-receiving recess 384 at each end thereof. A transverse groove 392 extends across and divides the top surface 380 into approximately equal halves. A countersunk oblong aperture 394 is defined in a midpoint area of the transverse groove 392. As seen in FIG. 17 and in greater detail in FIG. 18, several flanges 366 depend downwardly from the underside of the top wall 380 adjacent each sidewall 382.

The flanges 366 are generally in vertical alignment with each end of the brushes 402 and are adapted to releasably mount a hub flange 368 to the cover 18. Each flange 366 comprises a C-shaped member 370 having a transverse rectangular aperture 372 therein. The bight of the C-shaped member 370 faces toward the interior of the cover 318.

The hub flange 368 comprises first and second rectangular members 404 and 406 which are interconnected at a common end so that the first member 404 is offset inwardly from the second member 406. A shoulder 408 is defined on the offset plane between the first and second members 404 and 406. The first member 404 includes a circular protrusion 410 which extends inwardly adjacent an end of the first member 404 opposite the shoulder 408. The second member 406 includes a ramp 412 which extends inwardly adjacent an end of the second member 408 so that the ramp 412 defines an increasing gradient inwardly and defines a shoulder 414 at an inner end of the ramp.

Each sidewall 330 of the base 316 is adapted to support a shaped axle 454 which, in turn, rotatably supports a pair of wheels 456 in a longitudinally-spaced relationship. Each sidewall 330 includes a first support 440 and a second support 442 to support the axle 454. The first support 440 comprises a rectangular protrusion which extends outwardly from each sidewall 330 spaced downwardly from the upper edge 332. The second support 442 comprises an L-shaped flange which opens outwardly towards a forward respective or rearward end of the lower unit 312.

The axle 454 is shown in greater detail in FIG. 19. The axle 454 comprises a resilient wire 458 having each end deformed into an L-shaped extension 460 defined by a perpendicular length 462 and a lateral length 464 at a lower end thereof. Each outer end of the lateral length 464 can be provided with an angular tip 468 which is adapted to retain a wheel 456 thereon so that the wheels 456 can rotate about the lateral length 464 but not to become inadvertently removed therefrom. A U-shaped spring is defined at a central region of the wire 458 and includes a bight portion 466 which extends laterally and angularly therefrom in an opposite direction as the lateral lengths 464.

A conventional wheel/axle assembly 400 comprises a pair of wheels 470 rotatably supported on an axle 472 as shown in FIG. 17. Each outer end of the axle 472 preferably extends beyond an outer face of the wheels 470.

The brushes 402 are any type of known brush material wound around an axle having a pair of hubs 474 disposed at each end which are provided with a circular axial aperture 476 therein as described in the previous embodiment.

The axle 454 is mounted to the sidewalls 330 on a common longitudinal side of the base 316 by locating the wire 458 on the first supports 440 so that the bight portion 466 extends into the central channel 348 and engages the notch 346 in the flanges 340 on each housing 322 and 324. The L-shaped extensions 460 are engaged within the second support 442 so that the wheels 456 depend downwardly within the channel 336. The second supports 442 permit a small degree of outward deflection by the L-shaped extensions 460. The lateral lengths 464 extend normal to the sidewalls 330.

The axle 472 is mounted to the base 316 by passing the axle 472 through the gaps 356 adjacent the flanges 350 so that the axle rests in the transverse channel in each flange 350 and atop the tabs 362. The wheels 470 are thereby mounted in the same longitudinal plane as the wheels 456 mounted onto the sidewalls 330 on each side of the base 316. The outer ends of the axle 472 can slide longitudinally within the channel with the notches 358 and tabs 362 providing support thereto.

The handle assembly is mounted to the lower unit 312 in the same manner as in the first embodiment shown in FIGS. 2, 12 and 13 is not described further here. The cover 318 can be fixedly mounted to the base 316 by several threaded fasteners or the interlocking engagement of teeth or flanges on the cover and the base.

The brushes 402 are mounted to the cover 318 by locating the circular protrusion 410 on a hub flange 368 within an aperture 476 in a hub 474. A hub flange 368 should be mounted to each side of each brush 402 in this manner. The brush 402 and the attached hub flanges 368 can then be moved upwardly so that the second member 406 of each hub flange 368 slides within a corresponding C-shaped member 370 of a flange 366 adjacent the sidewalls 382 of the cover 318. As the hub flanges 368 are urged upwardly, the ramps 412 inwardly bias the flanges 366 on the cover 318 away from the sidewall 382. As the ramps 412 extend upwardly a sufficient extent so that the shoulder 414 lies wholly in the aperture 372 in the flanges 366, the ramps 412 cause the flanges 366 to spring outwardly due to the resilient nature of the flanges 366. The hub flanges 368 are thereby locked within the flanges 366 by the engagement of each ramp 412 and each shoulder 414 within a corresponding aperture 372.

Referring to FIG. 17, a pair of dust drawers 498 and 500 are provided, each of which forms a debris-receiving area 502 defined by a pair of transverse walls 504 and a pair of sidewalls 506. An interior transverse wall 504 can include an inwardly-contoured surface adapted to be positioned adjacent a rounded surface, such as wheels 456, so as to be able to be placed immediately adjacent the rounded surface and to not abut thereagainst. The opposite transverse wall 504 can include a aesthetic face plate 510 adapted to create a surface flush with the sidewalls 382 and the top surface 380 of the cover 318 when the drawers 498, 500 are mounted within the lower unit 312. The face plate 510 can include a rounded recess 512 along a lower portion thereof to form a handle for a user.

The drawers 498, 500 are spaced longitudinally and disposed at the respective front and rear ends of the lower unit 312 to form front and rear walls of the lower unit 312. The walls 504 and 506 of the drawers 498, 500 cooperate with the walls 328 of the base 316 to form openings into which debris can be tossed by an adjacent brush 402.

The drawers 498, 500 are slidably mounted within the housings 322 and 324 on the base 316 by insertion through the drawer-receiving recesses 384 in the cover 318. The drawers 498, 500 are slidably inserted along rails on the base 316. The drawers 498, 500 can be removed for emptying by pulling axially outwardly on the drawer 498, 500, perhaps by grasping the recess 512 on the face plate 510.

The wheel/axle assembly 400 is journaled within the notches 358 in the flanges 350 so that the wheel/axle assembly 400 slides longitudinally upon the forward and backward movement of the sweeper 310 over a ground surface as in the previous embodiment.

Because the face plate 510 of each drawer 498, 500 forms the leading or trailing portion of the sweeper 310 during use, bumpers 344 are disposed on the exposed forward and rearward ends of the lower unit 312 of the sweeper 310. For this purpose; and as shown in FIG. 17, the bumper 344 comprises an elastomeric strip 520 which is contoured to the ends of the lower unit 312 and which has an L-shaped ridge 522 extending rearwardly therefrom. The bumper 344 is also provided with an elastomeric outer edge 528 formed of a flexible stretchable resilient material. The bumper can thereby be mounted to the base 316 (prior to mounting the cover 318) by hooking the L-shaped ridge 522 between the edges of the cover 318 and base 316.

Figure 20:
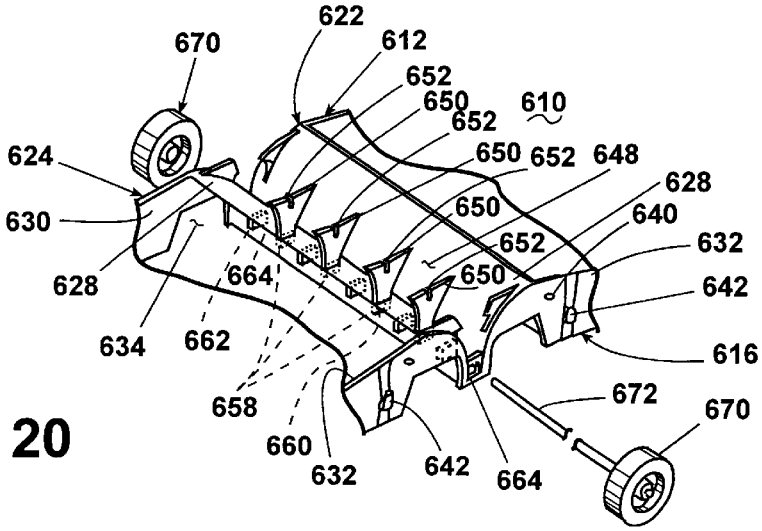
FIG. 20 is a fragmentary exploded view of a third embodiment of a floor sweeper according to the invention with several elements of the sweeper removed for clarity.

FIG. 20 shows a third embodiment of a floor sweeper. It will be understood that reference numerals to common components in FIG. 20 are greater by 300 than the reference numerals to the corresponding components in the second embodiment shown in FIGS. 17–19 and greater by 600 than corresponding components in the first embodiment shown in FIGS. 1–16. A sweeper 610 according to this embodiment of the invention comprises a lower unit 612 having substantially the same configuration as that of the second embodiment described therein.

The lower unit 612 comprises a base 616, a cover and a wheel/brush assembly. The base 616 comprises first and second housings 622 and 624. It will be understood that the housings 622 and 624 are similar components which are described by common reference numerals for shared components or features.

Each housing 622 and 624 comprises an interior transversely-extending semi-cylindrical wall 628 which terminates in a pair of sidewalls 630 having a tapering upper edge 632. Each sidewall 630 further includes a rectangular aperture 634 adjacent the semi-cylindrical wall 628.

It will be further understood that the first and second housings 622 and 624 are disposed on the base 616 so that the semi-cylindrical walls 628 of each housing 622 and 624 are located at an inward central portion of the base 616 and the sidewalls 630 of each housing 622 and 624 extend forwardly and rearwardly therefrom and define longitudinal walls of the base 616.

A central channel 648 of the base 616 is defined between the semi-cylindrical walls 628 of the first and second housings 622 and 624. Several spaced integrally-molded flanges 650 extend longitudinally outwardly into the channel 648 and interconnect the housings 622 and 624. Each flange 650 is provided with a semi-circular recess 652 at an upper edge thereon which is adapted to pivotably mount a portion of the handle assembly. The flanges 650 are further provided with a rectangular aperture 658 located at a lower central portion of the flanges 650 which define a transverse channel 660 which extends between the longitudinal edges of the base 616 and through the apertures 658 in the flanges 650. Further, a floor 664 of the transverse channel 660 can be provided with an upwardly-extending tab 662 which extends between the housings 622 and 624 and across the channel 648. The tabs 662 have an upper edge which generally corresponds to a lower edge of the aperture 658.

It will be understood that the flanges 650 extend completely across the channel 648 in the third embodiment as opposed to only partially across the channel 648 as in previous embodiments. Thus an axle 672 which is adapted to support wheels 670 must be transversely inserted from one side of the base 616 through the apertures 658. The tabs 662 can provide additional support thereto.

The base 616 further includes first and second supports 640 and 642 adapted to support an axle such as that shown in FIG. 19. The supports 640 and 642 are similar to that shown in FIG. 17 of the second embodiment and mount the axle in a similar manner.

The remaining components of the third embodiment are similar to those of the first and second embodiments. These components are assembled and operate in a similar manner.

Reasonable variation and modification are possible within the spirit of the foregoing specification and drawings without departing from the scope of the invention.

What is claimed is:

1. A sweeper comprising:

a housing;

at least one debris collector;

at least one brush rotatably mounted to the housing for sweeping debris into the at least one debris collector;

the housing forming an opening for mounting the at least one debris collector for movement between an open and a closed position;

at least two axles mounted to the housing, each axle mounting a pair of wheels;

the at least one brush is mounted between the at least two axles;

the housing comprises a pair of separate cassettes and a base, the base has opposite sides, the cassettes are mounted to the opposite sides of the base, and the cassettes mount at least one of the two axles and the at least one brush;

wherein the at least two axles comprises a first axle and a second axle, the first and second axles are U-shaped and are each mounted to one of the cassettes and support a pair of wheels on one of the sides of the base;

whereby the at least one of the two axles can be mounted to the cassettes and then mounted to the base as a unit.

2. The sweeper of claim 1 wherein each of the cassettes further comprises an elongated retainer positioned intermediate ends of the first and second axles, and the at least two axles further comprises a third axle having a pair of ends, and the elongated retainer on each cassette mounts an end of the third axle therein for sliding movement of the third axle with respect to the cassettes.

3. The sweeper of claim 2 wherein at least one spring member biases at least one of the first, second and third axles with respect to at least a portion of each of the cassettes.

4. The sweeper of claim 2 wherein the at least one brush comprises a pair of elongated brushes which are mounted to at least one of the pair of separate cassettes on either side of the third axle.

5. The sweeper of claim 4 wherein each of the elongated brushes has ends with a hub and an aperture in the hub and each of the cassettes comprises a pair of circular protrusions forming bearings for journaling the hubs thereon.

6. The sweeper of claim 5, wherein the protrusions are positioned on flexible tab portions of at least one of the pair of separate cassettes and the tab portions are resilient to selectively release the pair of elongated brushes from the cassettes.

7. The sweeper of claim 1 wherein the base and the cassettes have detents and retainers for snap-fit connection of each cassette to the base.

8. The sweeper of claim 1 wherein each of the cassettes have first, second and third portions, the second portion being between the first and third portion, a first spring interconnects the first and second portions and a second spring interconnects the second and third portions, the first and third portions have retainers thereon, the at least two axles have legs which are mounted in the retainers, and the springs bias the legs within the retainers.

9. The sweeper of claim 1 wherein the at least one brush comprises a pair of elongated brushes which are mounted to at least one of the pair of cassettes on opposing end portions thereof.

10. The sweeper of claim 9 wherein each of the two brushes have ends with a hub and an aperture in the hub and each of the cassettes comprises a pair of circular protrusions forming bearings for journaling the hubs thereon.

11. The sweeper of claim 9 wherein the cassettes each have flexible tab portions thereon, the flexible tab portions each have a circular protrusion thereon, the circular protrusions each receive an end of one of the two brushes and the tab portions are resilient to selectively release the two brushes from the cassettes.

12. A sweeper comprising:

a housing;

at least one drawer;

at least one brush rotatably mounted to the housing for sweeping debris into the at least one drawer;

the housing forming an opening for removably mounting the at least one drawer for movement between an open and a closed position;

at least two axles mounted to the housing, each axle mounting a pair of wheels;

the at least one brush mounted between the at least two axles;

the housing comprises a base and a cover;

a bail pivotally mounted to the housing, the bail comprises a vertical handle portion and a horizontal connector portion;

the cover and base have opposing flanges with notches therein which cooperate to receive and pivotally mount the horizontal connector portion when the cover is mounted to the base.

13. The sweeper of claim 12 wherein the bail is T-shaped.

14. The sweeper of claim 13 wherein the vertical handle portion has a frustoconical connector which snap-fits into a socket in an end portion of a handle shaft.

15. The sweeper of claim 12 wherein the vertical handle portion has a frustoconical connector which snap-fits into a socket in an end portion of a handle shaft.

16. A sweeper comprising:

a housing having a pair of opposing sides and at least two resilient retainers mounted to each opposing side thereof, wherein the housing further comprises a cover and the retainers and the cover have a detent mechanism for snap-fit mounting the retainers to the cover;

at least one debris collector;

at least one brush rotatably mounted to the housing for sweeping debris into the at least one debris collector;

the housing forming an opening for mounting the at least one debris collector for movement between an open and a closed position;

at least two axles mounted to the housing, each axle mounting a pair of wheels;

the at least one brush mounted between the at least two axles, the at least one brush having a pair of ends, each end of the at least one brush having a rotatable support element;

the at least two retainers having a bearing for journaling a respective rotatable support element of the at least one brush thereon;

whereby the retainers releasably mount the at least one brush for rotation on the housing.

17. The sweeper of claim 16 wherein the rotatable support element upon the ends of the at least one brush comprises a hub with an aperture and the bearing comprises a cylindrical protrusion.

18. A sweeper comprising:

a housing;

at least one debris collector;

at least one brush rotatably mounted to the housing for sweeping debris into the at least one debris collector;

the housing forming an opening for mounting the at least one debris collector for movement between an open and a closed position;

at least two axles mounted to the housing, each axle mounting a pair of wheels;

the at least one brush is mounted between the at least two axles;

the housing comprises a pair of separate cassettes and a base, the base has opposite sides, the cassettes are mounted to the opposite sides of the base, and the cassettes mount at least one of the two axles and the at least one brush;

wherein each of the cassettes have first, second and third portions, the second portion being between the first and third portion, a first spring interconnects the first and second portions and a second spring interconnects the second and third portions.

19. A sweeper comprising:

a housing having a base with a pair of opposing sides and at least two resilient retainers mounted to each opposing side of the base;

at least one debris collector;

at least one brush rotatably mounted to the housing for sweeping debris into the at least one debris collector;

the housing forming an opening for mounting the at least one debris collector for movement between an open and a closed position;

at least two axles mounted to the housing, each axle mounting a pair of wheels;

the at least one brush mounted between the at least two axles, the at least one brush having a pair of ends, each end of the at least one brush having a rotatable support element;

the at least two retainers each having a bearing for journaling a respective rotatable support element of the at least one brush thereon;

the at least two retainers and the housing have a detent mechanism therebetween for snap-fit mounting the at least two retainers to the housing;

whereby the at least two retainers releasably mount the at least one brush for rotation on the housing and further releasably mount the retainers to the housing.

20. The sweeper of claim 19 wherein the rotatable support element upon the ends of the at least one brush comprises a hub with an aperture and the bearing comprises a cylindrical protrusion.

* * * * *